US006971884B2

(12) United States Patent
Zhao et al.

(10) Patent No.: US 6,971,884 B2
(45) Date of Patent: Dec. 6, 2005

(54) ELECTRICAL CONNECTOR HAVING HEAT-DISSIPATION STRUCTURE

(75) Inventors: Qijum Zhao, Kunsan (CN); Jinkui Hu, Kunsan (CN); Guohua Zhang, Kunsan (CN)

(73) Assignee: Hon Hai Precision Ind., Co., Ltd., Taipei Hsien (TW)

( * ) Notice: Subject to any disclaimer, the term of this patent is extended or adjusted under 35 U.S.C. 154(b) by 0 days.

(21) Appl. No.: 10/659,602

(22) Filed: Sep. 9, 2003

(65) Prior Publication Data

US 2004/0242052 A1 Dec. 2, 2004

(51) Int. Cl.[7] ..... H01R 12/18
(52) U.S. Cl. ..... 439/62; 439/485
(58) Field of Search ..... 439/485, 59, 62, 439/160

(56) References Cited

U.S. PATENT DOCUMENTS

| | | | | |
|---|---|---|---|---|
| 4,461,522 A | * | 7/1984 | Bakermans et al. | 439/62 |
| 5,059,133 A | | 10/1991 | Hikami et al. | |
| 5,156,552 A | * | 10/1992 | Zaderej et al. | 439/59 |
| 5,672,069 A | | 9/1997 | Cheng et al. | |
| 6,210,195 B1 | | 4/2001 | Ma | |

* cited by examiner

*Primary Examiner*—Renee Luebke
(74) *Attorney, Agent, or Firm*—Wei Te Chung

(57) ABSTRACT

An electrical connector (100) includes an insulative housing (1) and a number of electrical contacts (2). The insulative housing includes a base (10) having a pair of side walls (13), a slot (15) formed between the two side walls, and a number of passageways (19) and recesses (17) both defined on the side walls. Each side wall has an outer face (132) and each recess extends from a corresponding passageway to the outer face. The electrical contacts are received in the passageways of the insulative housing.

10 Claims, 3 Drawing Sheets

ELECTRICAL CONNECTOR HAVING HEAT-DISSIPATION STRUCTURE

BACKGROUND OF THE INVENTION

1. Field of the Invention

The present invention generally relates to an electrical connector, and more particularly to an electrical connector having a heat-dissipation structure.

2. Description of Related Art

Card edge connectors which electrically connect electrical cards to mother boards within a limited space of a computer or other like electronic device are well known. A conventional card edge connector as shown in U.S. Pat. Nos. 5,059,133, 5,672,069, and 6,210,195 generally includes an insulative housing defining a slot for receiving a mating edge of a complementary electrical card and a plurality of passageways on opposite side walls of the slot and communicating with the slot, and a plurality of contacts received in the passageways. The contacts have mating portions exposed in the slot for contacting with conductive pads on the mating edge of the complementary electrical card and tail portions extending beyond a mounting face of the insulative housing.

However, openings of the passageways in the mounting face of the insulative housings are usually covered or closed by the mother board when the card edge connector is mounted on the mother board. Heat generated in the card edge connector thus cannot be quickly dissipated through the openings of the passageways in the mating face of insulative housing, thereby increasing the temperature of the card edge connector and adversely affecting the electrical connection between the card edge connector and the electrical card.

Hence, a card edge connector having an improved heat-dissipation structure is desired.

SUMMARY OF THE INVENTION

An object of the present invention is to provide a card edge connector having an improved heat-dissipation structure through which heat generated therein can be quickly dissipated.

To achieve the above object, an electrical connector in accordance with the present invention comprises an insulative housing and a plurality of electrical contacts. The insulative housing comprises a base having a pair of side walls, a slot formed between the two side walls, and a plurality of passageways and recesses both defined on the side walls. Each side wall has an outer face and each recess extends from a corresponding passageway to the outer face of the side wall. The electrical contacts are received in the passageways of the insulative housing.

Other objects, advantages and novel features of the invention will become more apparent from the following detailed description when taken in conjunction with the accompanying drawings.

DETAILED DESCRIPTION OF THE INVENTION

Figure 1:
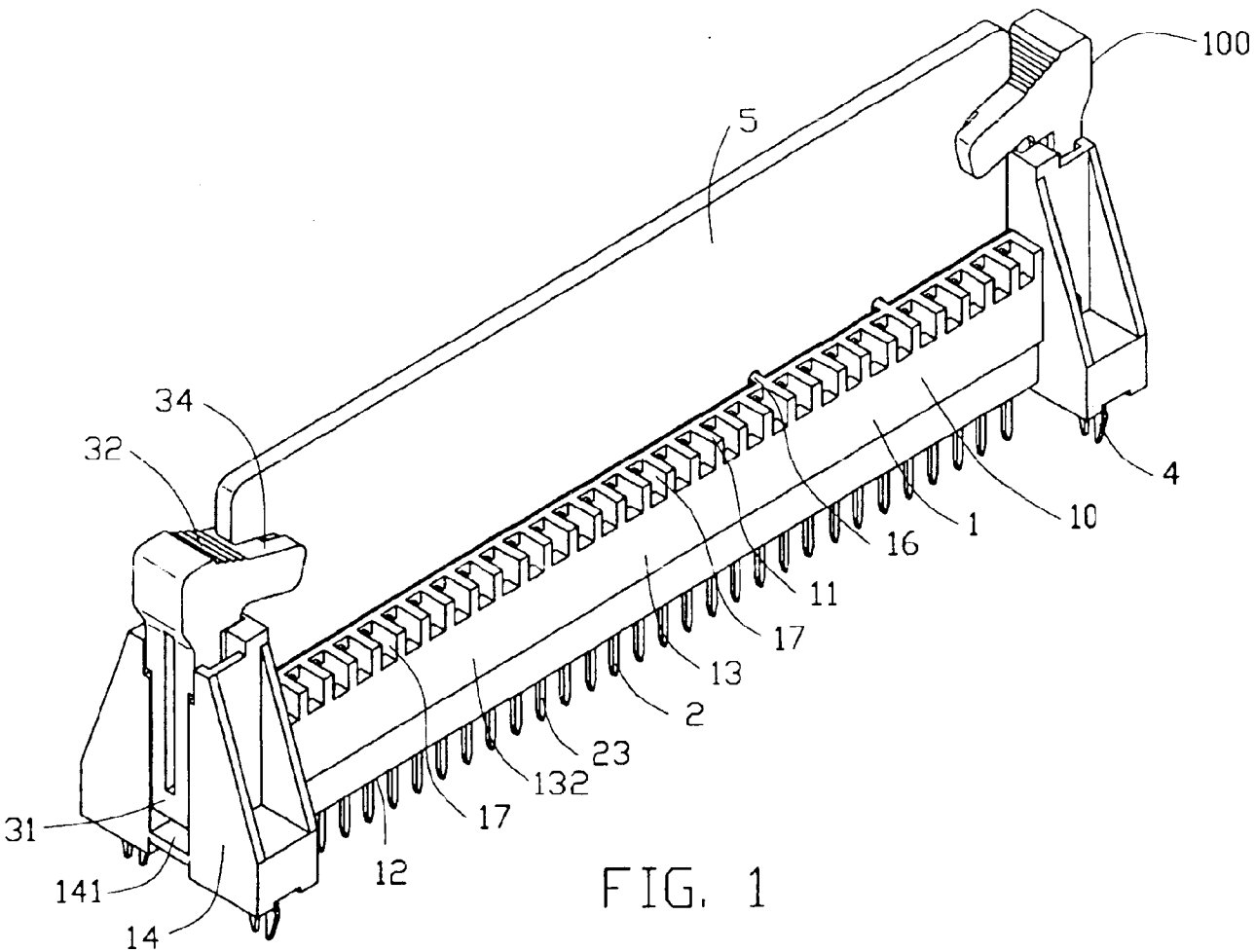
FIG. 1 is an assembled perspective view of an electrical connector in accordance with the present invention and mated with a complementary electrical card.
Figure 2:
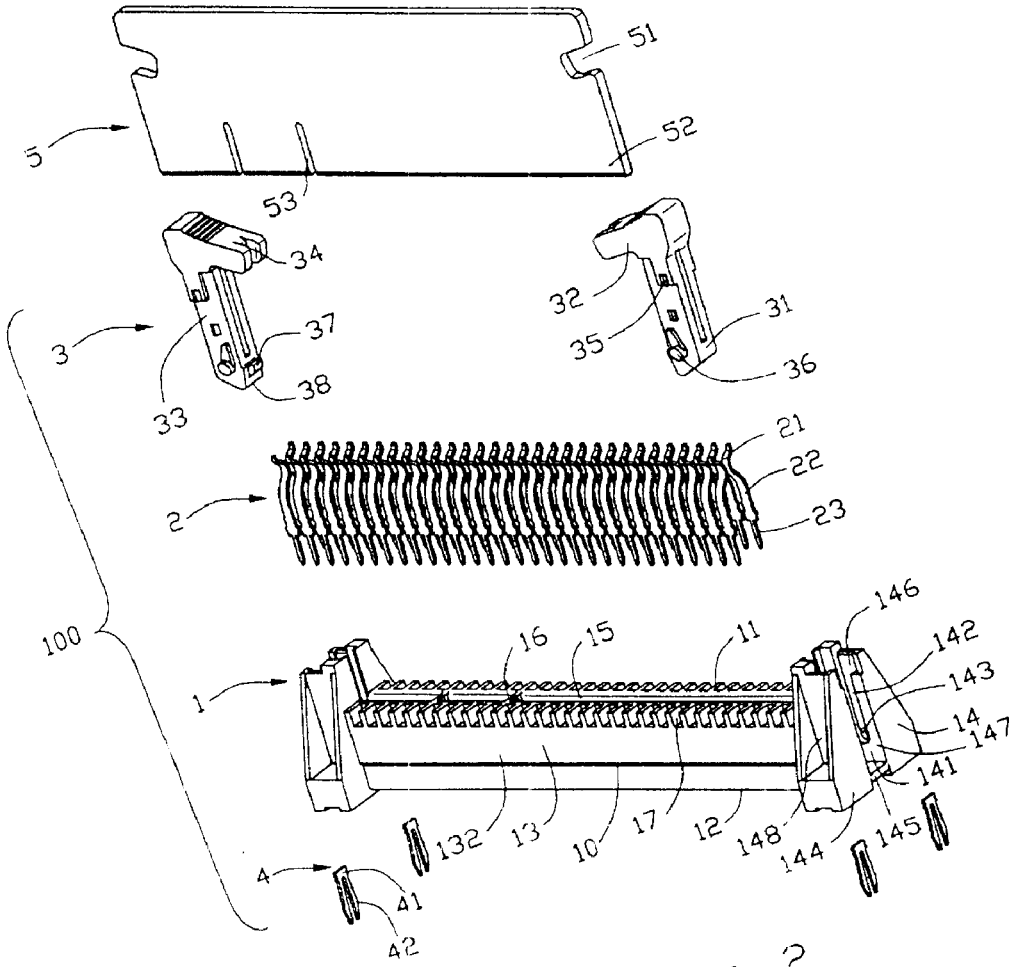
FIG. 2 is an exploded perspective view of the electrical connector of FIG. 1 and the electrical card.

Referring to FIGS. 1 and 2, an electrical connector 100 in accordance with the present invention is used to mate with an electrical card 5 and comprises an insulative housing 1, a plurality of electrical contacts 2, a pair of latch members 3 and two pairs of retention structures 4.

The electrical card 5 comprises a pair of cutouts 51 defined on opposite ends thereof, a mating edge 52 on a bottom end thereof and two notches 53 defined in the mating edge 52.

Figure 3:
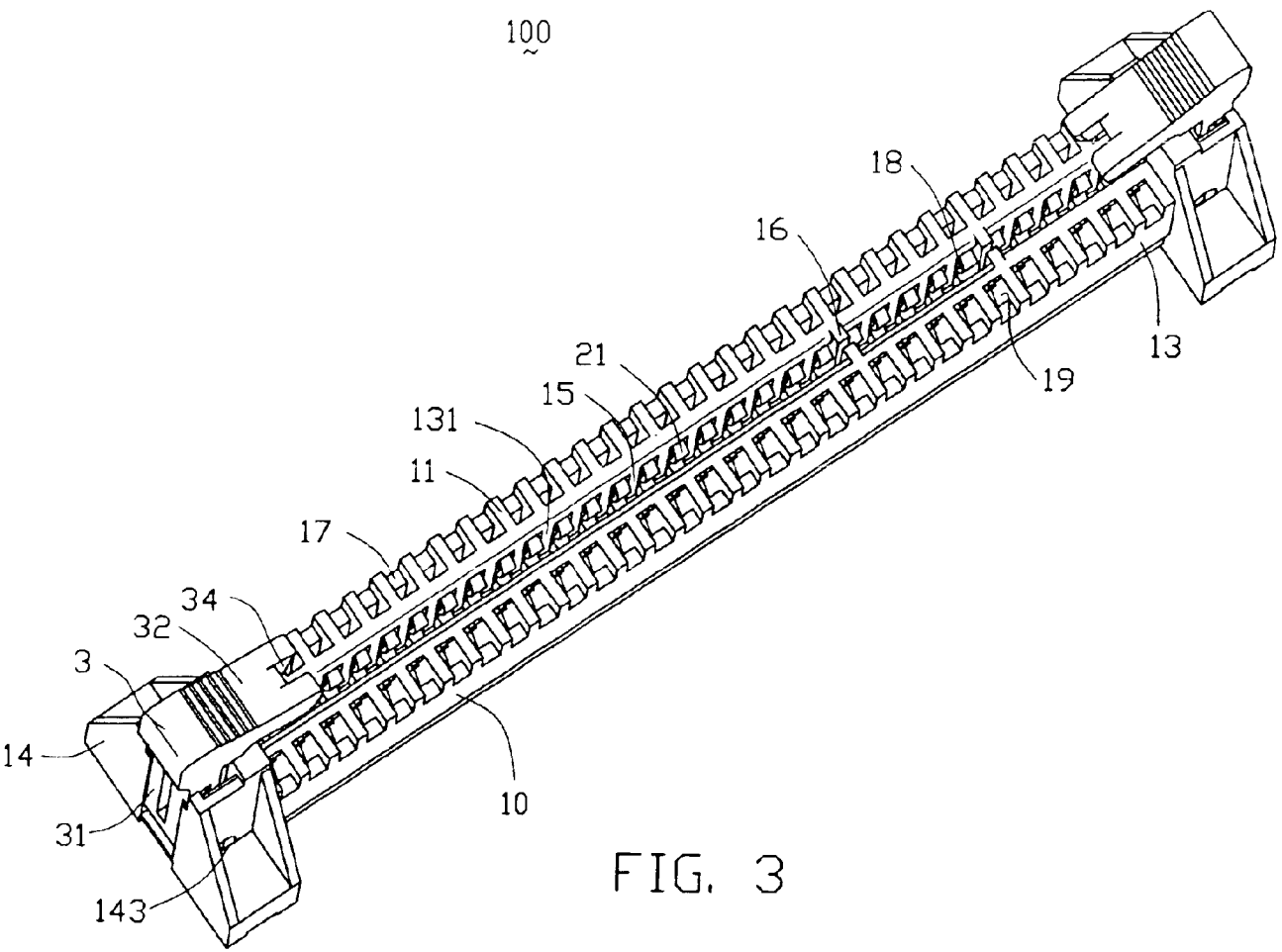
FIG. 3 is a view similar to FIG. 1 but taken from a different aspect and not showing the electrical card.

Further referring to FIGS. 1 and 2 in conjunction with FIG. 3, the insulative housing 1 comprises an elongated base section 10, a pair of mounting sections 14 provided on opposite ends of the base section 10. The base section 10 comprises a pair of elongated side walls 13 and a slot 15 formed between the two side walls 13. Each side wall 13 has a mating face 11, a mounting face 12 opposite to the mating face 11, an inner face 131, and an outer face 132 opposite to the inner face 131. The two side walls 13 are formed with two pairs of polarizing ribs 16 on the inner face 131 thereof. The polarizing ribs 16 are received in the notches 53 of the electrical card 5 to ensure the electrical card 5 is properly oriented edgewise within the slot 15. Each side wall 13 defines a plurality of passageways 19 extending from the mating face 11 to the mounting face 12 and arranged therealong. Each passageway 19 has an opening 18 in the inner face 131 of the side wall 13. A plurality of recesses 17 are defined in the mating face 11 of each side wall 13. Each recess 17 communicates with a corresponding passageway 19 and extends from the passageway 19 to the outer face 132 along the mating face 11. Each mounting section 14 comprises a pair of stand-offs 144, a connecting plate 145 connecting lower portions of the two stand-offs 144, and a pair of support plates 146 extending upwardly from the two stand-offs 144 and spaced from each other. The two support plates 146 defines a receiving space 141 therebetween. Each support plate 146 has an inner face 147, an outer face 148 opposite the inner face 147, a hole 143 extending from the inner face 147 to the outer face 148, and a U-shaped groove 142 extending from a top end thereof to the hole 143 along the inner face 147.

The electrical contacts 2 are received in the passageways 19 of the insulative housing 1. Each electrical contact 2 comprises a retention portion 22 interferentially fitted in the passageway 19, a mating portion 21 extending upwardly from the retention portion 22 and partially exposed in the slot 15 through the opening 18, and a tail portion 23 extending downwardly from the retention portion 22.

Each latch member 3 comprises a body portion 31 having an inner face 38 and two opposite side faces 33, a locking portion 32 extending downwardly and inwardly from a top end of the body portion 31, and an eject portion 37 projecting inwardly from a lower end of the inner face 38 of the body portion 31. The body portion 31 is formed with a plurality of projections 35 and a pair of spindles 36 on the two side faces 33. A free end of the locking portion 32 is divided into two end pieces 34. The latch member 3 is assembled to the insulative housing 1 by the spindles 36 sliding in the grooves 142 of the support plates 146 of the mounting portion 14 on one end of the base section 10 from top ends of the grooves 142 into the holes 143 and being received therein. Each latch member 3 can rotate outwardly from its upright or locked position to its release position around the corresponding spindles 36.

When the mating edge 52 of the electrical card 5 is fully inserted into the slot 15 of the insulative housing 1, the latch members 3 rotate to their upright positions with the body portions 31 are received in the receiving spaces 141 of the mounting sections 14. The locking portions 32 engage with the cutouts 51 of the electrical card 5 for retaining the electrical card 5 in the slot 15. The two pieces 34 of the locking portion 32 clamp opposite side faces of the electrical card 5 to prevent the electrical card 5 from moving transversally.

Each retention structure 4 comprises a mounting portion 41 received in a recess (not shown) of the stand-off 144 of the insulative housing 1 and a pair of the leg portions 42 spaced from each other and extending downwardly beyond a mounting face of the stand-off 144 for mounting the card edge connector 100 to a printed circuit board (not shown).

Each of the recesses 17 extends from a corresponding passageway 19 outwardly toward and terminating at the outer face 132 of the side wall 13 so as to be exposed to an exterior in a transverse direction. Heat generated in the electrical connector 100 is quickly dissipated through the recesses 17 to prevent the temperature of the insulative housing 1 of the electrical connector 100 from increasing and to decrease the probability of the deformation of the insulative housing 1 because of high temperature. This therefore ensures the function of the electrical connector 100 and reliable electrical connection between the electrical connector 100 and the electrical card 5. It is noted that the recess 17 remains substantially empty/unblocked in use (as shown in FIG. 1) without therein the redundant parts, e.g. the contact/shielding piece of either the connector 100 or the mating counterpart for implementation of the better heat dissipation.

It is important to note that though the recesses 17 are defined on top ends of the side walls 13 in this embodiment, the recesses 17 can also be defined in middle or lower portions of the side walls 13, or even in an alternate/zigzag manner as long as such recesses communicate with the exterior in the transverse direction without improper obstruction.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing comprising a base having a pair of side walls, each side wall defining a mating face, a mounting face, an outer face exposed to an exterior in a transverse direction and an inner face opposite to the outer face;

a slot formed between the two side walls and extending along a longitudinal direction;

a plurality of passageways and recesses both defined in the side walls, each recess extending from a corresponding passageway outwardly toward and terminating at the outer face of the sidewall; and a plurality of electrical contacts received in the passageways of the insulative housing; wherein the insulative housing comprises a mounting section on each end of the base, the mounting section comprising a pair of standoffs, a connecting plate connecting lower portions of the two stand-offs, and a pair of support plates extending upwardly and spaced from each other.

2. The electrical connector as claimed in claim 1, wherein the pair of support plates define a pair of holes, and a pair grooves extending downwardly from top ends thereof to the pair of holes.

3. The electrical connector as claimed in claim 2 further comprising a pair of latch member assembled to the mounting sections, each latch member comprising a body portion having two opposite side faces, a pair of spindles on the side faces and received in the holes of the support plates, and a locking portion from a top end of the body portion.

4. The electrical connector as claimed in claim 2 further comprising a plurality of retention structures each having a mounting portion retained in a corroding stand-off and a pair of leg portions extending downwardly from the mounting portion.

5. An electrical connector comprising:

an insulative housing comprising a base having a pair of side walls, each of said walls defining an outer face exposed to an exterior in a transverse direction;

a slot formed between the two side walls and extending along a longitudinal direction of the housing perpendicular to said transverse direction;

a plurality of passageways defined in the side walls along a vertical direction perpendicular to both said longitudinal and said transverse direction, and in communication with the slot;

a plurality of recesses defined in the side walls, each of the said recesses extending from the corresponding passageway outwardly toward and terminating at the outer face of the side wall so as to be exposed to the exterior in said transverse direction; and a plurality of electrical contacts received in the passageways of the insulative housing; wherein each of the said recesses remains empty for better heat dissipation.

6. The electrical connector as claimed in claim 5, wherein at least some of said recesses communicate with the exterior in the vertical direction.

7. The electrical connector as claimed in claim 5, wherein said recesses are located at a same level.

8. An electrical connector comprising:

an insulative housing comprising a base having a pair of side walls, each of said walls defining an outer face exposed to an exterior in a transverse direction;

a slot formed between the two side walls and extending along a longitudinal direction of the housing perpendicular to said transverse direction;

a plurality of passageways defined in the side walls along a vertical direction perpendicular to both said longitudinal and said transverse direction, and in communication with the slot;

a plurality of recesses defined in the side walls, each of the said recesses extending from the corresponding passageway outwardly toward and terminating at the outer face of the side wall so as to be exposed to the exterior in said transverse direction;

a plurality of electrical contacts received in the passageways of the insulative housing; and a printed circuit board inserted into the slot along said insertion direction and mechanically and electrically connected to the electrical contacts; wherein each of the said recesses remains substantially unblocked for better heat dissipation.

9. The electrical connector as claimed in claim 8, wherein at least some of said recesses communicate with the exterior in the vertical direction.

10. The electrical connector as claimed in claim 5, wherein said recesses are located at a same level.

* * * * *